US006682156B2

(12) United States Patent
Herrington

(10) Patent No.: US 6,682,156 B2
(45) Date of Patent: Jan. 27, 2004

(54) APPARATUS FOR CONTROLLING ACCESS TO A PLURALITY OF DRAWERS

(75) Inventor: Geoffrey Herrington, Surrey (GB)

(73) Assignee: Supply Point Systems Ltd., Leicestershire (GB)

( * ) Notice: Subject to any disclaimer, the term of this patent is extended or adjusted under 35 U.S.C. 154(b) by 0 days.

(21) Appl. No.: 10/226,860

(22) Filed: Aug. 23, 2002

(65) Prior Publication Data

US 2003/0001466 A1 Jan. 2, 2003

Related U.S. Application Data

(63) Continuation of application No. 09/743,629, filed as application No. PCT/GB99/02262 on Jul. 14, 1999, now abandoned.

(30) Foreign Application Priority Data

Jul. 16, 1998 (GB) ..... 9815515

(51) Int. Cl.[7] ..... A47B 88/00

(52) U.S. Cl. ..... 312/215; 312/333; 250/221

(58) Field of Search ..... 312/215, 216, 312/217, 222, 319.5, 333, 330.1; 221/2, 3; 250/221, 222.1, 559.4, 559.32

(56) References Cited

U.S. PATENT DOCUMENTS

| | | | |
|---|---|---|---|
| 1,381,839 | A | 6/1921 | Jackson |
| 2,005,918 | A | 6/1935 | Lovingood |
| 2,500,437 | A | 3/1950 | Tandler et al. |
| 2,513,595 | A | 4/1950 | Stewart |
| 2,634,185 | A | 4/1953 | Wilder |
| 2,636,795 | A | 4/1953 | Williams |
| 2,952,385 | A | 9/1960 | Stayton |
| 3,001,669 | A | 9/1961 | Tandler et al. |
| 3,128,909 | A | 4/1964 | Shield et al. |
| 3,344,953 | A | 10/1967 | Krakauer et al. |
| 3,445,035 | A | 5/1969 | Ackerman |
| 3,635,321 | A | 1/1972 | Frazier, Sr. |
| 3,675,551 | A | 7/1972 | Land et al. |
| 3,752,359 | A | 8/1973 | Shaw |
| 3,802,600 | A | 4/1974 | Shaw |
| 3,954,202 | A | 5/1976 | Petrick |
| 3,959,997 | A | 6/1976 | Williams |
| 3,969,008 | A | 7/1976 | Pergler |
| 4,066,308 | A | 1/1978 | Wedel |
| 4,084,149 | A | 4/1978 | Driver et al. |
| 4,134,520 | A | 1/1979 | Collins et al. |

(List continued on next page.)

FOREIGN PATENT DOCUMENTS

| | | | |
|---|---|---|---|
| CA | 990246 | | 6/1976 |
| CH | 682477 | A5 | 7/1990 |
| DE | 4302711 | A1 | 2/1993 |
| EP | 429660 | A1 | 5/1990 |
| FR | 2587306 | A1 | 4/1986 |
| GB | 9776 | | of 1909 |
| JP | 4316194 | * | 11/1992 |
| WO | 94/15501 | * | 7/1994 |

*Primary Examiner*—Lanna Mai
*Assistant Examiner*—Hanh V. Tran
(74) *Attorney, Agent, or Firm*—Withrow & Terranova, PLLC

(57) ABSTRACT

An apparatus for controlling access to a plurality of drawers, in one embodiment being tool dispensing apparatus (10) comprising a housing (12), a plurality of drawers (26) within the housing (12), each drawer for storing one or more tools, and a control system (14–22, 34–50) for controlling access to the drawers (26). Preferably, the apparatus (10) comprises a plurality of drawer trays (28) located in the housing (12) and on each of which one or more drawers (26) is located. The drawers are preferably divided into compartments and a control mechanism for providing access to appropriate compartments is disclosed in detail.

15 Claims, 2 Drawing Sheets

Figure 1:
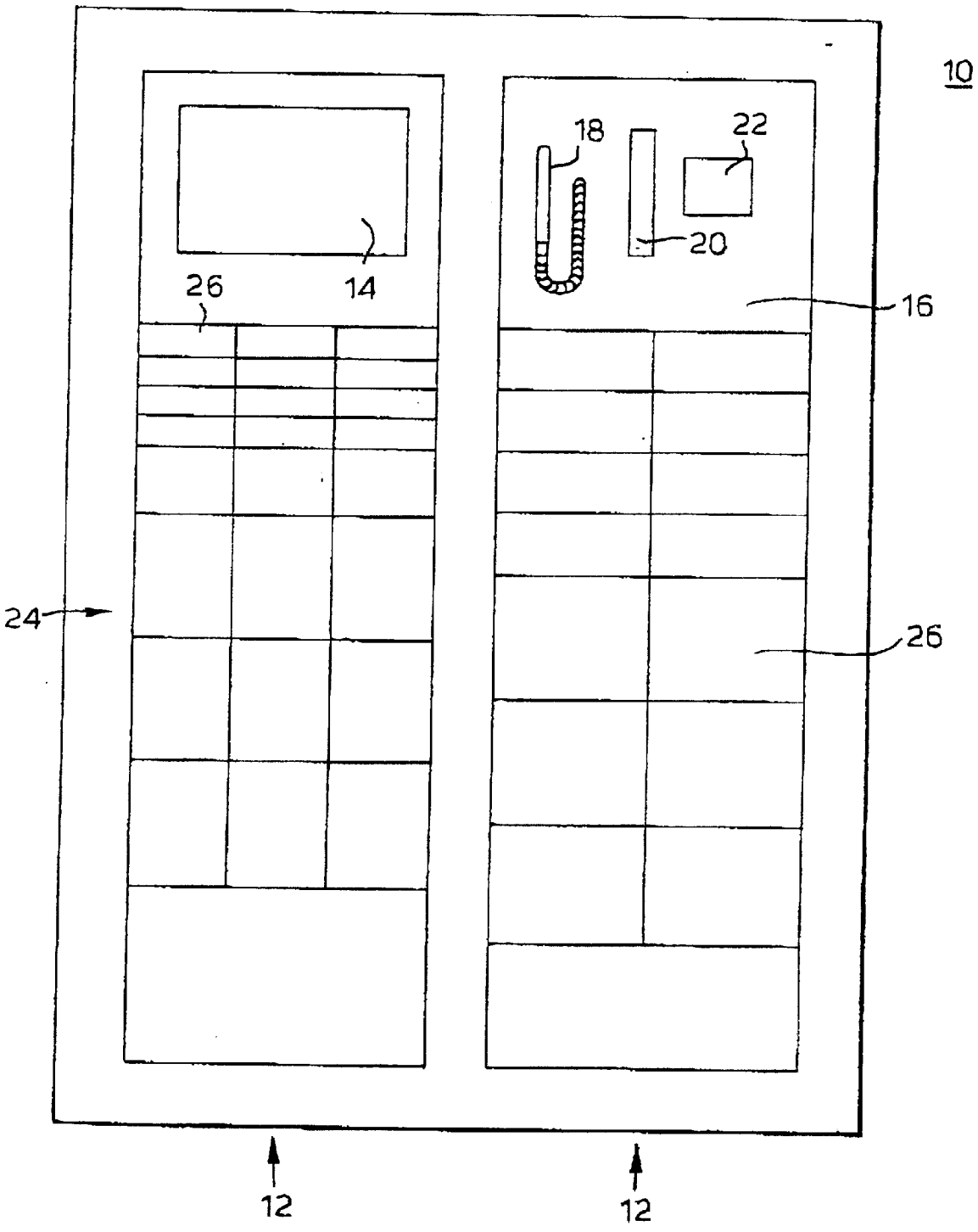

U.S. PATENT DOCUMENTS 4,332,315 A 6/1982 Ward
4,393,789 A 7/1983 Glotfelter
4,438,704 A 3/1984 Hutcheon
4,557,476 A 12/1985 Kato
4,620,754 A 11/1986 Lycke et al.
4,669,589 A 6/1987 Rogers
4,682,319 A 7/1987 Einhaus
4,693,364 A 9/1987 Wakelin
4,720,154 A 1/1988 Seiter
4,763,810 A 8/1988 Christiansen
4,775,199 A 10/1988 Lanius et al.
4,842,348 A 6/1989 Ackeret
4,846,367 A 7/1989 Guigan et al.
4,865,404 A 9/1989 Harper
4,871,054 A 10/1989 Murray
4,927,051 A 5/1990 Falk et al.
4,961,507 A 10/1990 Higgins
5,014,865 A 5/1991 Sauber
5,014,875 A 5/1991 McLaughlin et al.
5,038,023 A 8/1991 Saliga
5,048,717 A 9/1991 Falk et al.
5,110,192 A 5/1992 Lauterbach
5,150,817 A 9/1992 Livingston
5,169,027 A 12/1992 Falk et al.
5,263,594 A 11/1993 Bianchi
5,285,926 A 2/1994 Falk et al.
5,314,243 A 5/1994 McDonald et al.
5,392,631 A * 2/1995 Elwell ..... 250/221
5,392,951 A 2/1995 Gardner et al.
5,408,443 A * 4/1995 Weinberger ..... 221/3
5,445,294 A 8/1995 Gardner et al.
5,473,545 A 12/1995 Schausten
5,499,707 A * 3/1996 Steury ..... 221/2
5,564,803 A 10/1996 McDonald et al.
5,623,408 A 4/1997 Motamedi et al.
5,716,114 A 2/1998 Holmes et al.
5,745,366 A 4/1998 Higham et al.
5,805,074 A 9/1998 Warren et al.
5,805,455 A 9/1998 Lipps
5,838,245 A * 11/1998 Murakami et al. ..... 250/559.4
5,855,423 A 1/1999 Cram
5,940,306 A 8/1999 Gardner et al.
6,011,999 A 1/2000 Holmes
6,065,819 A 5/2000 Holmes et al.
6,109,774 A 8/2000 Holmes et al.
6,123,223 A * 9/2000 Watkins ..... 221/121
6,129,433 A 10/2000 Rosenberg et al.
6,175,779 B1 * 1/2001 Barrett ..... 221/2
6,182,857 B1 * 2/2001 Hamm et al. ..... 221/2
6,356,794 B1 * 3/2002 Perin, Jr. et al.
6,427,032 B1 * 7/2002 Irons et al.
2002/0183882 A1 * 12/2002 Dearing et al.

* cited by examiner

APPARATUS FOR CONTROLLING ACCESS TO A PLURALITY OF DRAWERS

This is a continuation of Application 09/743,629, filed Mar. 12, 2001, now abandoned, which is a 371 of PCT/GB99/02262 filed Jul. 14, 1999.

The present invention relates to apparatus for controlling access to a plurality of drawers, one example of which is an apparatus for dispensing tools such as cutting tools and the like used with machine tools. Other examples include apparatus for dispensing drugs and apparatus for controlling access to legal documents such as Witness Statements.

Tools for use with machine tools are usually considered to be consumable items and it is necessary for replacement tools to be readily available, in steady supply at a location close to the machine tools in which they are used. Efficient inventory control is essential in order to ensure that the machine tools are kept in operation. Typically a store room might be provided and one or more persons employed to dispense the tools on request and to monitor use and re-stocking of the store. Of course, difficulties arise with sick leave, holidays and the cost of employment. There has thus been a long-standing desire for automation of inventory control and associated functions in relation to the supply and use of tools for machine tools.

It is thus one object of the present invention to provide an automated machine tool dispensing apparatus.

According to a first aspect of the present invention there is provided a tool dispensing apparatus comprising a housing, a plurality of drawers within the housing, each drawer for storing one or more tools, and a control system for controlling access to the drawers.

According to a second aspect of the present invention there is provided apparatus having a plurality of drawers and control means for controlling access to the content of the drawers, comprising at least one detector associated with each drawer with the detector being adapted and arranged to monitor when the drawer is in its fully closed position, to monitor the distance the drawer moves, to monitor the direction of movement of the drawer and to monitor the speed of movement of the drawer.

According to a third aspect of the present invention there is provided apparatus comprising a housing, a plurality of drawers, a plurality of drawer trays located in the housing and on each of which one or more drawers is located, and a control system for controlling access to the content of the drawers.

According to a fourth aspect of the present invention there is provided apparatus having a plurality of drawers and control means for controlling access to the content of the drawers, the control means comprising a central processor and a plurality of distributed processors, each distributed processor being associated with one or more respective drawers.

Figure 2:
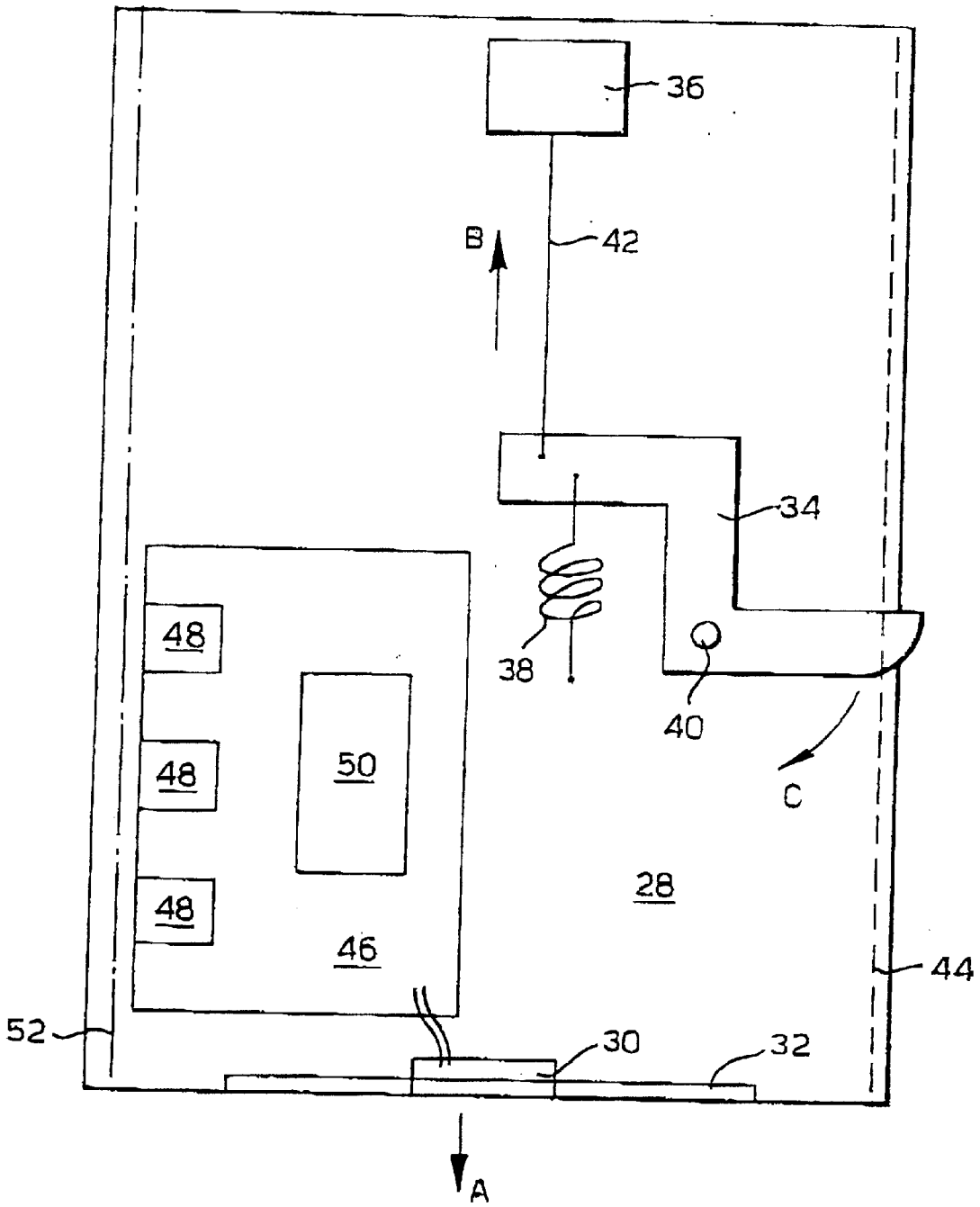

Embodiments of the present invention will now be described by way of example only and with reference to the accompanying drawings in which:

FIG. 1 is a front view of a tool dispensing apparatus in accordance with one embodiment of the present invention, and FIG. 2 is a plan view illustrating various components associated with the control of operation of the drawers.

A preferred embodiment of the invention will first be generally described with reference to FIG. 1.

The apparatus 10 comprises a modular framework with two framework modules 12 being used in the example shown in FIG. 1. The modules 12 are connected together and are then clad, using conventional techniques for example similar to those used for industrial racking. Although the dimensions of the modules may be chosen freely, a convenient size is 1750 mm high, 500 mm wide and 500 mm deep.

The number of framework modules connected together may be adjusted as desired, but preferably the minimum number is two. The reason for this is that it allows the top section of one module to house a computer display screen 14 and the top section of the adjacent module to house the computer hardware 16. The computer hardware is housed behind a front panel which carries an industrial light pen 18, for use with the display screen 14, a magnetic stripe reader 20 and a ticket printer 22. The arrangement is such as to dispense with the use of a conventional computer keyboard, all routine transactions being performed with the light pen and magnetic stripe reader. The computer hardware includes a modem to provide for data transfer, and possibly certain control functions, to be effected with a remote computer (not shown).

The main body 24 of each framework module 12 comprises a plurality of drawers 26. The drawers 26 are located on drawer trays 28 each of which extends across the width and depth of the framework. That is, the drawer trays 28 are provided one above the other within the main body 24 of the framework module 12. Vertical spacing of the drawer trays 28 is selected in accordance with the desired depth of drawer(s) 26 to be located on each tray. The drawer trays 28 are fixed to the framework on runners preferably using a locking bar arrangement (not shown).

As will be readily appreciated from FIG. 1, the number of drawers per tray can be varied as can the depth of drawers per tray. As illustrated; one, two or three drawers per tray are provided. Convenient draw heights might be 28 mm and 78 mm. Each drawer extends for essentially the full depth (back to front) of the framework. One or more dividers can be provided within each drawer across the width thereof, so as to provide a number of compartments which are accessed sequentially as the drawer is withdrawn from the framework. Thus, each drawer can provide one compartment or, using dividers, a number of separate compartments. In the preferred arrangement, eight, four, two or one compartment is provided within each drawer. Thus, if twenty trays are provided each with three drawers and each drawer has eight compartments, the total number of compartments for one module will be 480.

The drawer compartments are used to store tools. They provide for the computer controlled dispensing of the tools, in a manner which will be more fully appreciated from the following description of the drawer control system. From the description given thus far, it will however be apparent that a person requiring a new tool can identify themselves by "swiping" a magnetically encoded card through reader 20 and can then use the light pen 18 to instruct the release of a drawer for access to the appropriate compartment for the tool required. The light pen 18 interacts with the screen 14 to identify the tool required. Appropriate menus and instructions are displayed to assist the user, who only has to specify the tool required with all other functions being controlled automatically by the apparatus. A ticket can be printed, automatically or on demand, to provide the user with a printed record of the transaction. Generally, the apparatus controls the dispensing of tools and readily provides inventory control. The magnetic card identification system enables the apparatus to control the release of only specified tools to specified users. It can send inventory control information to a remote computer and/or provide such information on a "dial-in" basis. It can also send a warning message when drawers need replenishing. An historical database of the dispensing of tools is readily established.

FIG. 2 illustrates the components (34–42, 46–50) located on the drawer tray 28 associated with one drawer 26. The front of the framework and direction of withdrawal of the drawer is indicated by the arrow A.

Each drawer is held locked by a mechanical latch 34, which can be released by energising a respective solenoid 36. The latch is provided with a return spring 38 so as to re-lock the drawer whenever the solenoid is de-energised. This, of course, provides a fail-safe mechanism. The latch can be a simple dog-leg shaped member pivoted about a boss 40, as shown, or can be a more sophisticated arrangement. As shown, energising the solenoid 36 causes the connecting rod 42 to move in the direction of arrow B, against the force of spring 38, so that the locking end of the latch 34 moves in the arcuate path indicated by arrow C.

The latch and solenoid are located on the drawer tray 28 and a striker plate 44 (indicated by the dotted line in FIG. 2) for the latch is located on the underside of the drawer 26. With the preferred arrangement of up to eight compartments, the striker plate 44 has nine locking positions, one each for fully open and fully closed and seven intermediate positions.

Also located on the drawer tray 28 is a circuit board 46 which carries three photodetectors 48 and an integrated circuit (IC) 50. The drawer 26 carries a raster strip 52 (indicated by the chain line in FIG. 2) comprising a series of slots and webs which interact with the photodetectors 48. The arrangement is such that the strip 52 passes through the photodetectors 48 which operate on a photointeruption principle. Other equally suitable variations, such as a reflective system, will be immediately apparent to those skilled in the art.

Attached to circuit board 46 is a light source 30, such as an LED. The light source is arranged to illuminate the rear of the drawer hand grip 32 which is made of a transparent or translucent material. The light source 30 is switched on, under control of the computer 16, to indicate to the user which drawer they should pull open to access the tool they have selected using the light pen and display. The light source is switched off when the drawer has been opened to the correct position and then fully closed again.

The fully closed or "home" position of the drawer is defined by an extended web of the raster strip 52. The extended web and strip 52 are configured such that only when the drawer is in its home position are all three detectors occluded. When the drawer is partially or fully open, ie withdrawn from the framework, the slots and webs of the strip 52 are such that two adjacent detectors, but not three, can be fully illuminated or occluded. Thus the forward detector is used to detect the home position and the two rear most detectors are used to monitor movement of the drawer.

Detectors 48 and raster strip 52 not only provide positional information but also information concerning the speed and direction of movement of the drawer. Thus, from the information provided by the detectors 48 and raster strip 52, the computer 16 can control the apparatus in accordance with the home position, distance moved, direction of movement and speed of movement of each drawer. From the home position information, the computer 16 can control the apparatus so as only to allow a drawer to be opened when all other drawers are fully closed. Together with a database giving details of the compartments in each particular drawer, the distance moved information enables the computer to control release of the respective solenoid at the correct location for each drawer compartment. The direction of movement information enables the computer to compensate for any "dither" which may occur as a result of backwards and forwards movement of the drawer. Speed of movement information can be used, for example, to prevent abuse resulting from too rapid (manual) opening of the drawer.

As described above, control is effected by the computer 16. However, the control can be at least to some extent distributed with the IC 50 performing various counting and timing functions and the detail of energising and de-energising the solenoid 36. Also, it is possible to connect the outputs from several drawers in parallel and thereby reduce the number of components required, For example, it may be convenient to monitor each tray of drawers with a separate IC.

A common system bus provides each IC with the required power supply, clock signals and communications channels. The ICs are preferably programmable or specially fabricated to operate in accordance with the manner now described. First, the program should start when power supply first occurs or when it re-occurs, eg automatic program initialisation when the 5 volt power supply first rises above 4.75 volts. Subsequently, the program operates in two mutually exclusive modes, namely a communications (COMMS) mode and a counting/timing (C/T) mode. The program starts in COMMS mode in which it is connected to the system bus and waits for control messages from the computer 16. Computer 16 can instruct the IC to perform a particular operation, such as allowing a particular drawer to be opened to provide access to a specified compartment, or to report the status of all drawers which it controls. Such an instruction from computer 16 sends the IC into C/T mode during which the required function is performed and during which the IC is effectively disconnected from the bus. When the required function is complete, or a time-out occurs, the IC switches back to COMMS mode and reports to the computer 16.

The foregoing description has been given in terms of a preferred embodiment and although several modifications have been mentioned specifically, it will be readily apparent to persons skilled in the art that various other modifications can be made without departing from the scope of the invention as defined by the appendant claims. One particular modification not previously mentioned is to replace the illustrated manual opening of the drawers by an arrangement, such as a worm driven gear, which opens the drawer automatically. Another modification would be to replace the described photodetectors by other forms of detectors, such as mechanical or magnetic detectors.

As indicated in the introduction above, an apparatus for dispensing tools is one implementation of the present invention. In one aspect the invention relates to an apparatus for controlling access to the content of a plurality of drawers. Such an apparatus may be used to dispense drugs in a hospital using apparatus as described above in relation to the dispensing of tools. Advantageously, the user identification described above can be enhanced so as to provide more detailed control of which drugs are being dispensed for which patients at what frequency. Additionally, the apparatus for controlling access to the content of a plurality of drawers can be used in a wide range of other applications. For example, the drawers of the embodiment described above can be used for storing Witness Statements in a Police Station. Conventionally, a Police Officer requiring access to a Witness Statement has manually to complete a log book entry identifying the Officer, the date, time etc. It will be apparent that such information can be logged automatically using the apparatus described above.

What is claimed is:

1. An apparatus for holding and obtaining an item, comprising:

a housing;

a plurality of drawer trays contained in said housing wherein each of said plurality of trays contains one or more drawers, each of said one or more drawers comprising:

a plurality of compartments that are capable of storing the item;

a striker plate;

a solenoid-controlled latch wherein said latch engages said striker plate to lock said drawer in place when said latch is not energized;

a raster strip; and three photodetectors located in proximity to each other and located in proximity to said raster strip wherein said three photodetectors illuminate light towards said raster strip; and a controller communicatively coupled to each said latch for said one or more drawers wherein said controller is adapted to energize said latch to disengage each said latch from said striker plate to unlock said one or more drawers;

said controller adapted to receive a transaction request for the item in said housing and wherein said controller de-energizes said latch to lock said one of said one or more drawers when all of said three photodetectors are occluded.

2. The apparatus of claim 1 wherein said three photodetectors are occluded when said one or more drawers are closed.

3. The apparatus of claim 1 wherein said controller is adapted to determine the position of said one or more drawers when opened by determining when two of said three photodetectors are occluded or not.

4. The apparatus of claim 1 wherein said controller is adapted to determine direction and speed of movement of said one or more drawers when opened by determining when two of said three photodetectors are occluded or not.

5. The apparatus of claim 3 wherein said controller de-energizes said latch when said drawer is opened to one of said plurality of compartments that contains the item requested.

6. The apparatus of claim 1 wherein said housing further comprises a user interface coupled to said controller wherein said user interface allows a user to input a transaction request for the item.

7. The apparatus of claim 6 wherein said user interface comprises a display adapted to provide menus and instructions to a user.

8. The apparatus of claim 7 wherein said user interface further comprises a light pen adapted to allow the user to input said transaction request for the item through said display.

9. The apparatus of claim 6 wherein said user interface comprises a magnetic stripe card reader coupled to said controller.

10. The apparatus of claim 6 wherein said user interface comprises a ticket printer adapted to print a printed record of said transaction.

11. The apparatus of claim 1 further comprising a modem communicatively couple to said controller wherein said modem is adapted to transmit inventory information.

12. The apparatus of claim 11 wherein said controller is further adapted to transmit a warning message using said modem when any of said one or more drawers need replenishing.

13. The apparatus of claim 1 wherein each of said one or more drawers further comprises a light source adapted to illuminate when said one or more drawers has been unlocked and further adapted to deilluminate after said one or more drawers has been returned to its closed position.

14. The apparatus of claim 1 wherein each of said one or more drawers further comprises a return spring adapted to re-lock said drawer after said latch is de-energized.

15. The apparatus of claim 1 further wherein each of said one or more drawers further comprises an automatic opening mechanism adapted to open said one or more drawers upon energizing of said latch and close said one or more drawers upon de-energizing said latch.

* * * * *